US007607754B2

(12) United States Patent
Murashima

(10) Patent No.: US 7,607,754 B2
(45) Date of Patent: Oct. 27, 2009

(54) INKJET RECORDING APPARATUS

(75) Inventor: Hiroshi Murashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 203 days.

(21) Appl. No.: 11/861,270

(22) Filed: Sep. 25, 2007

(65) Prior Publication Data

US 2008/0211851 A1 Sep. 4, 2008

(30) Foreign Application Priority Data

Sep. 25, 2006 (JP) ..... 2006-258490

(51) Int. Cl.
*B41J 29/393* (2006.01)

(52) U.S. Cl. ..... 347/19

(58) Field of Classification Search ..... 347/14, 347/15, 17, 19; 358/504
See application file for complete search history.

(56) References Cited

U.S. PATENT DOCUMENTS 5,576,745 A * 11/1996 Matsubara ..... 347/14
6,231,154 B1 * 5/2001 Corrigan ..... 347/17
7,438,376 B2 * 10/2008 Tamura et al. ..... 347/17

FOREIGN PATENT DOCUMENTS

JP 2004022294 A 1/2004

* cited by examiner

*Primary Examiner*—Lamson D Nguyen
(74) *Attorney, Agent, or Firm*—Baker Botts L.L.P.

(57) ABSTRACT

An inkjet recording apparatus has a conveyor for conveying a recording medium in a conveying direction, at least one recording head having a flow path unit, a driver IC configured to output a drive signal, and an actuator configured to actuate ink in the flow path based on the drive signal, and a controller for controlling each of the conveyor and the at least one recording head. At least one recording head of the at least one recording heads has a temperature sensor for detecting a current temperature of the driver IC of the recording head. The controller has a detecting unit for comparing the current temperature with a particular predetermined temperature, a driving control unit for driving the driver IC based at least on the current temperature, and a cycle determining unit for determining an ejection cycle of at least one recording head.

17 Claims, 7 Drawing Sheets

INKJET RECORDING APPARATUS

CROSS REFERENCE TO RELATED APPLICATION

The present application claims priority from Japanese Patent Application No. 2006-258490, which was filed on Sep. 25, 2006, the disclosure of which is herein incorporated by reference in its entirety.

BACKGROUND OF THE INVENTION

1. Field of the Invention

The present invention relates to an inkjet recording apparatus that performs recording by ejecting ink droplets to a recording medium.

2. Description of Related Art

A known inkjet recording apparatus, such as an inkjet printer, performs printing by ejecting ink droplets onto a recording medium, such as a sheet. Such an inkjet printer includes a recording head including a flow path unit and an actuator, and a driver integrated circuit (IC) configured to generate pulse signals for driving the actuator. The flow path unit includes nozzles configured to eject ink droplets therefrom and pressure chambers that are in fluid communication with the nozzles. The actuator is configured to apply ejection energy to ink in the pressure chambers to eject ink from the nozzles. The actuator changes the volumetric capacity of the pressure chambers to apply the ejection energy to ink in the pressure chambers. The actuator is driven by the application of the drive pulse signals from the driver IC.

It is desirable for inkjet printers to print at high speeds. If high speed printing is achieved by shortening an ink ejection cycle, increased frequencies of the drive pulse signals output from the driver IC are needed. If the drive IC continuously outputs drive signal pulses with higher frequency, the driver IC radiates an increased amount of heat. As described in Japanese Laid-Open Patent Publication No. 2005-22294, a driver IC may be stopped (i.e., printing may be stopped) and may be cool when the temperature of the driver IC exceeds a predetermined temperature, to prevent the driver IC from being damaged by the heat. The driver IC may be driven again after its temperature is reduced to a second predetermined temperature.

The driver IC may be naturally cooled until its temperature is reduced to the second temperature. When operating in an ambient atmosphere, printing may be frequently interrupted, which may decrease printing speed, and may interfere with high-speed printing.

SUMMARY OF THE INVENTION

Therefore, a need has arisen for inkjet recording apparatus, systems, and methods for using the same, which overcome these and other shortcomings of the related art. A technical advantage of an embodiment of the invention is to provide a recording apparatus that may achieve high-speed recording while preventing a driver IC from being damaged by heat.

In an embodiment of the invention, an inkjet recording apparatus comprises a conveyor configured to convey a recording medium in a conveying direction, at least one recording head comprising a flow path unit, a driver IC configured to output a drive signal, and an actuator configured to actuate ink in the flow path based on the drive signal, and a controller configured to control each of the conveyor and the at least one recording head. At least one recording head of the at least one recording heads further comprises a temperature sensor configured to detect a current temperature of the driver IC of the at least one recording head. The controller comprises a detecting unit configured to compare the current temperature with a particular predetermined temperature, a driving control unit configured to drive the driver IC based at least on the current temperature, and a cycle determining unit configured to determine an ejection cycle of the at least one recording head, wherein when the current temperature is less than the particular predetermined temperature, the driver IC of the at least one recording head is driven in a first ejection cycle, and wherein when the current temperature is greater than or equal to the particular predetermined temperature, the driver IC of the at least one recording head is driven in a second ejection cycle.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
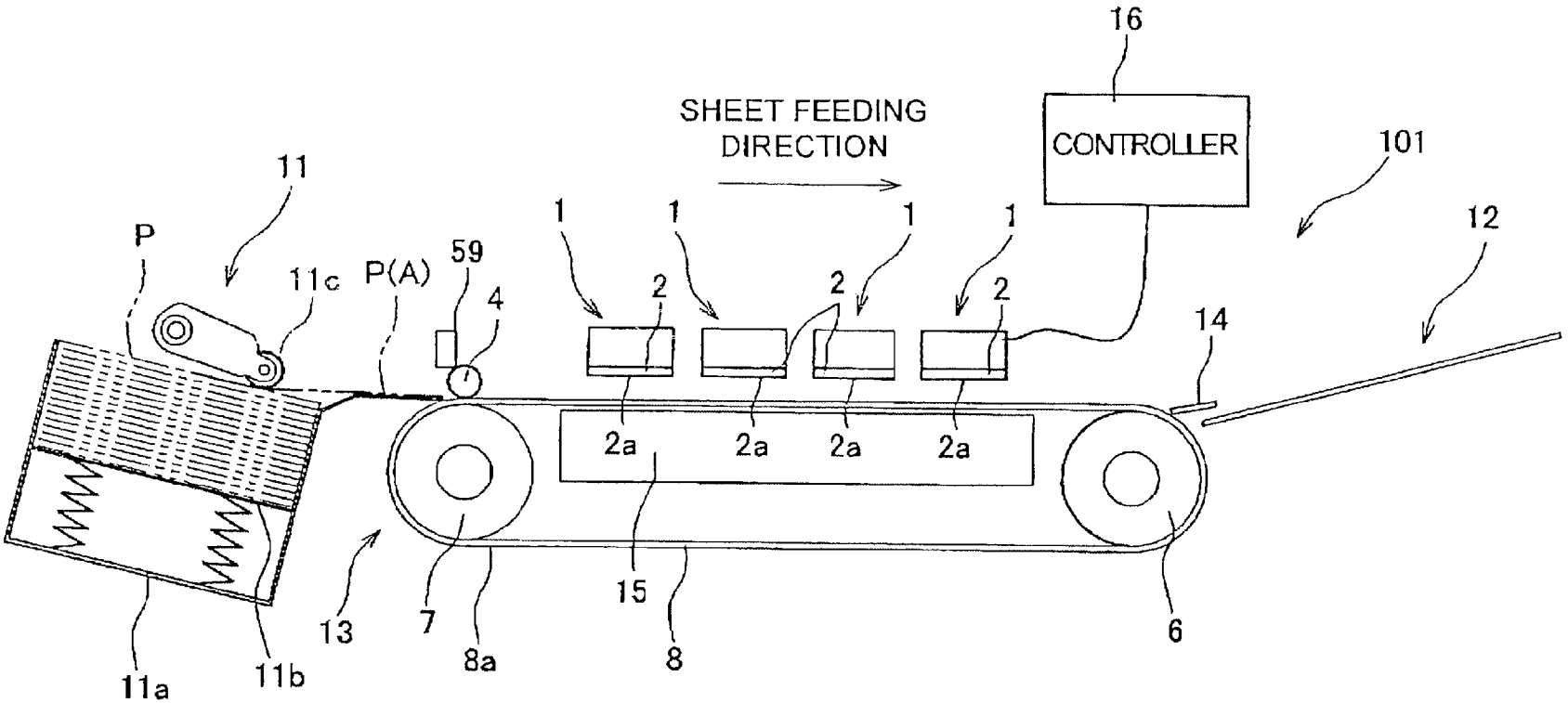
FIG. 1 is a side view of an inkjet recording apparatus according to an embodiment of the present invention.

Embodiments of the invention are described in detail with reference to the FIGS. 1-7, like reference numerals being used to describe corresponding parts in the various drawings.

As shown in FIG. 1, an inkjet recording apparatus, such as inkjet printer 101, e.g., a color inkjet printer, according to an embodiment of the present invention, may comprise at least one print head 1, e.g., a plurality of print heads, such as four print heads, and a controller 16 configured to control operations of inkjet printer 101. Inkjet printer 101 further may comprise a sheet feeder 11 and a sheet discharger 12, which may be disposed on the left and right side of inkjet printer 101 as oriented in FIG. 1, respectively.

Figure 4:
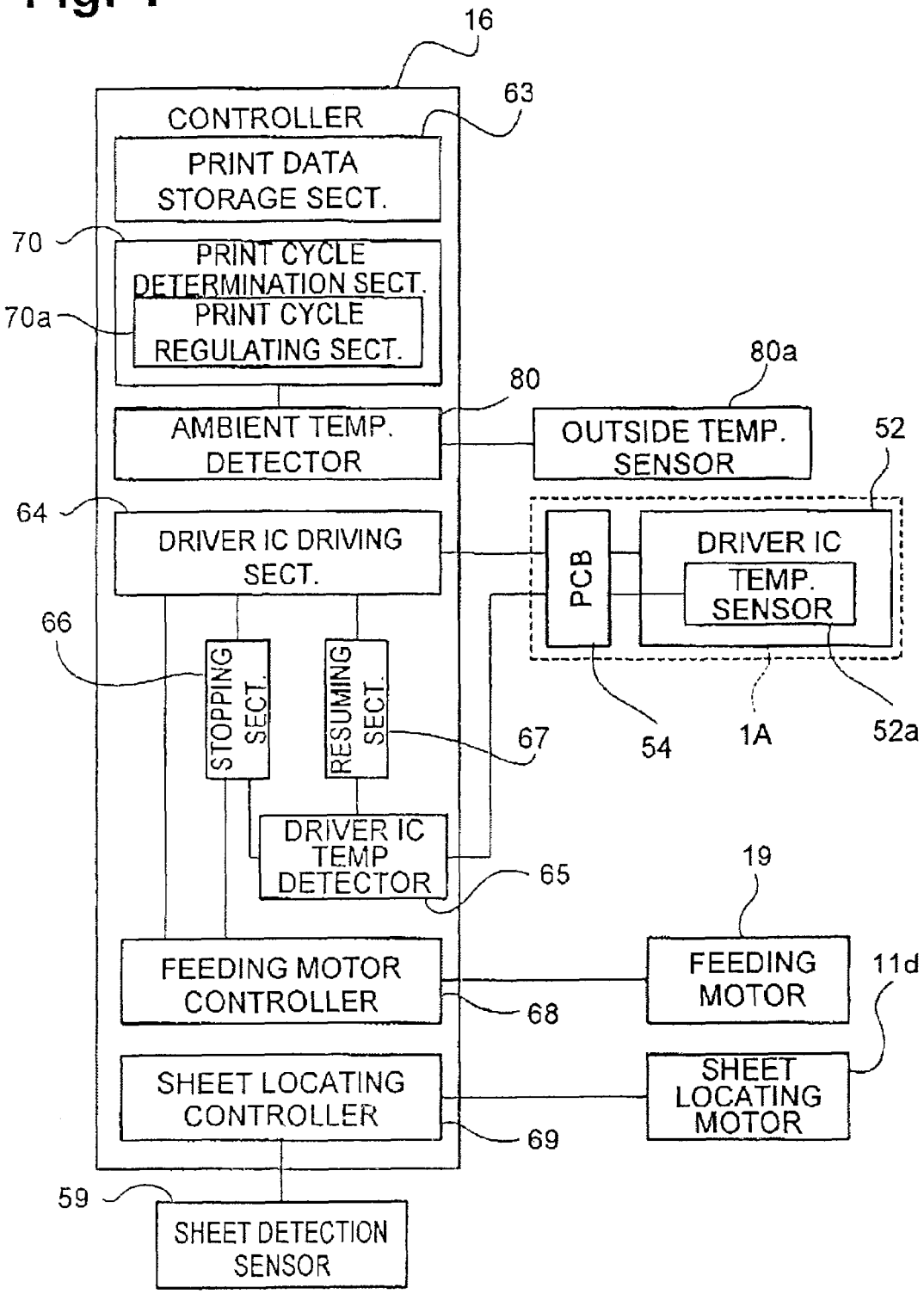
FIG. 4 is a block diagram of a controller of the inkjet recording apparatus of FIG. 1, according to an embodiment of the present invention.

Inkjet printer 101 may have a sheet feeding path therein, through which a recording medium, such as sheet P, is fed from sheet feeder 11 toward sheet discharger 12. Sheet feeder 11 may comprise a sheet stocker 11*a* and a pick-up roller 11*c*. Sheet stocker 11*a* may open upward, and may accommodate a plurality of sheets P therein. Sheet stocker 11*a* may be disposed at an angle, as shown in FIG. 1, with its right side lower than its left side. A support plate 11*b* that may be urged upward toward the opening of sheet stocker 11*a*, may be disposed inside sheet stocker 11*a*. A plurality of sheets P may be mounted on support plate 11*b*. As shown in FIG. 4, pick-up roller 11*c* may be driven by a sheet locating motor 11*d*, to transfer an uppermost one of sheets P accommodated in sheet stocker 11*a*, in a sheet feeding direction. Referring again to FIG. 1, a sheet detection sensor 59 may be disposed adjacent to sheet feeder 11, downstream of sheet feeder 11, in the sheet feeding direction. Sheet detection sensor 59 may be configured to detect when sheet P, fed by pick-up roller 11*c*, reaches a print standby position A, which may be near a conveyor belt 8, upstream of conveyor belt 8, in the sheet feeding direction. Sheet detection sensor 59 may be configured to detect a leading end, e.g., a downstream end of sheet P positioned at print standby position A. Sheet P, which may be fed from sheet stocker 11*a* by pick-up roller 11*c*, may pass through print standby position A to an outer surface 8*a* of conveyor belt 8.

A conveyor, such as belt conveyor mechanism 13, may be disposed substantially in a middle of the sheet feeding path. Belt conveyor mechanism 13 may comprise belt rollers 6, 7, conveyor belt 8 looped around rollers 6, 7, a feeding motor 19 (shown in FIG. 4) configured to rotate belt roller 6, and a platen 15, which may be disposed in an area surrounded by conveyor belt 8, so as to face print heads 1. Platen 15 may support conveyor belt 8 at an area surrounded by conveyor belt 8, to prevent conveyor belt 8 from flexing downward. A nip roller 4 may be disposed to face belt roller 7. When sheet P is conveyed to outer surface 8*a* by pick-up roller 11*c*, nip roller 4 also may press sheet P onto outer surface 8*a* of conveyor belt 8. When feeding motor 19 rotates belt roller 6, belt roller 6 may drive or circulate conveyor belt 8. Conveyor belt 8 may have a tacky surface for securing sheet P thereto. While conveyor belt 8 holds sheet P, and nip roller 4 presses sheet P against outer surface 8*a*, conveyor belt 8 may feed sheet P toward sheet discharger 12.

As shown in FIG. 1, a separation mechanism 14 may be disposed substantially immediately downstream of the conveyor belt 8 in the sheet feeding direction. Separation mechanism 14 may be configured to separate sheet P from outer surface 8*a*, and to feed sheet P toward sheet discharger 12.

Figure 2:
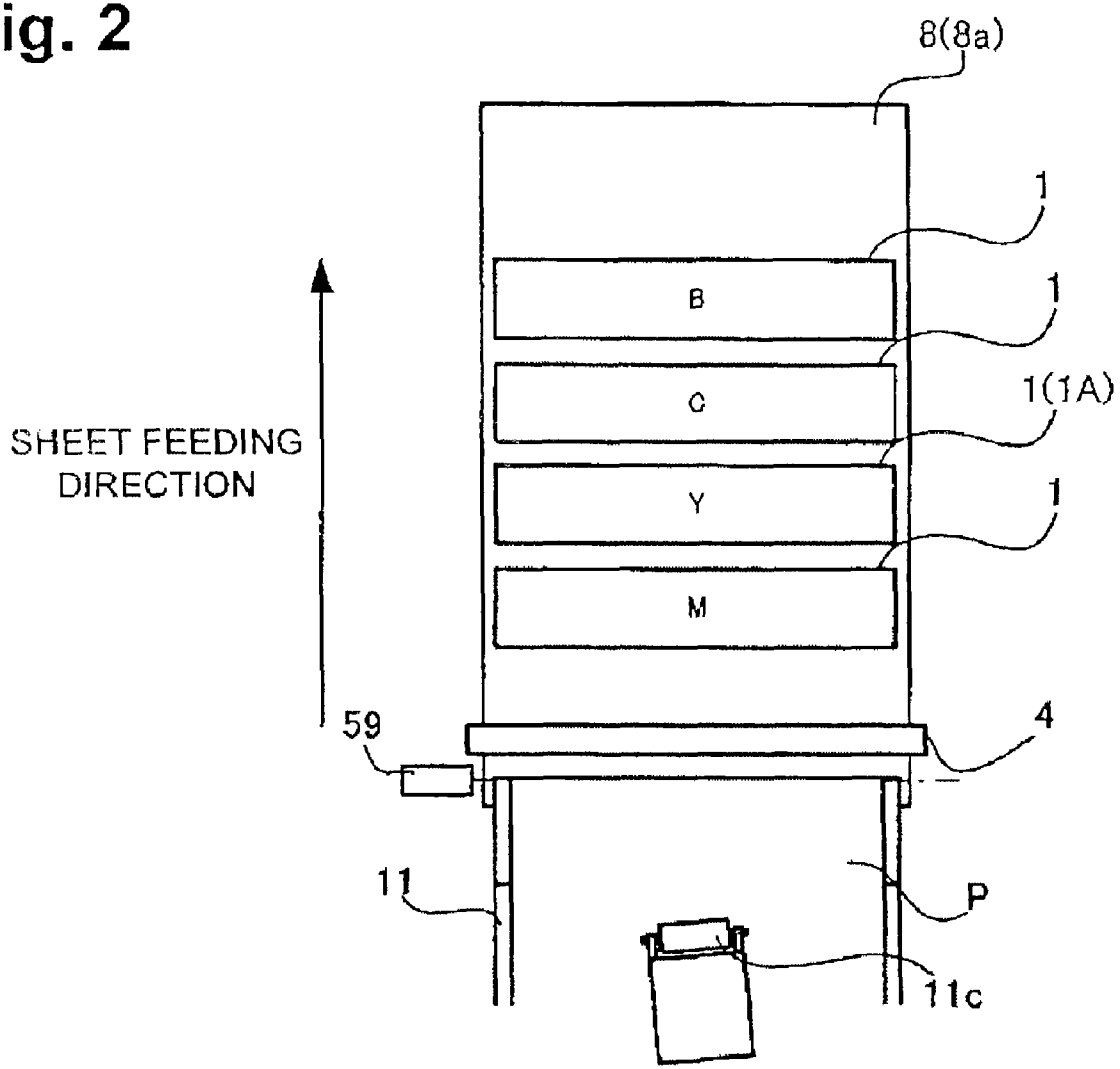
FIG. 2 is a top view of the inkjet recording apparatus of FIG. 1.
Figure 3:
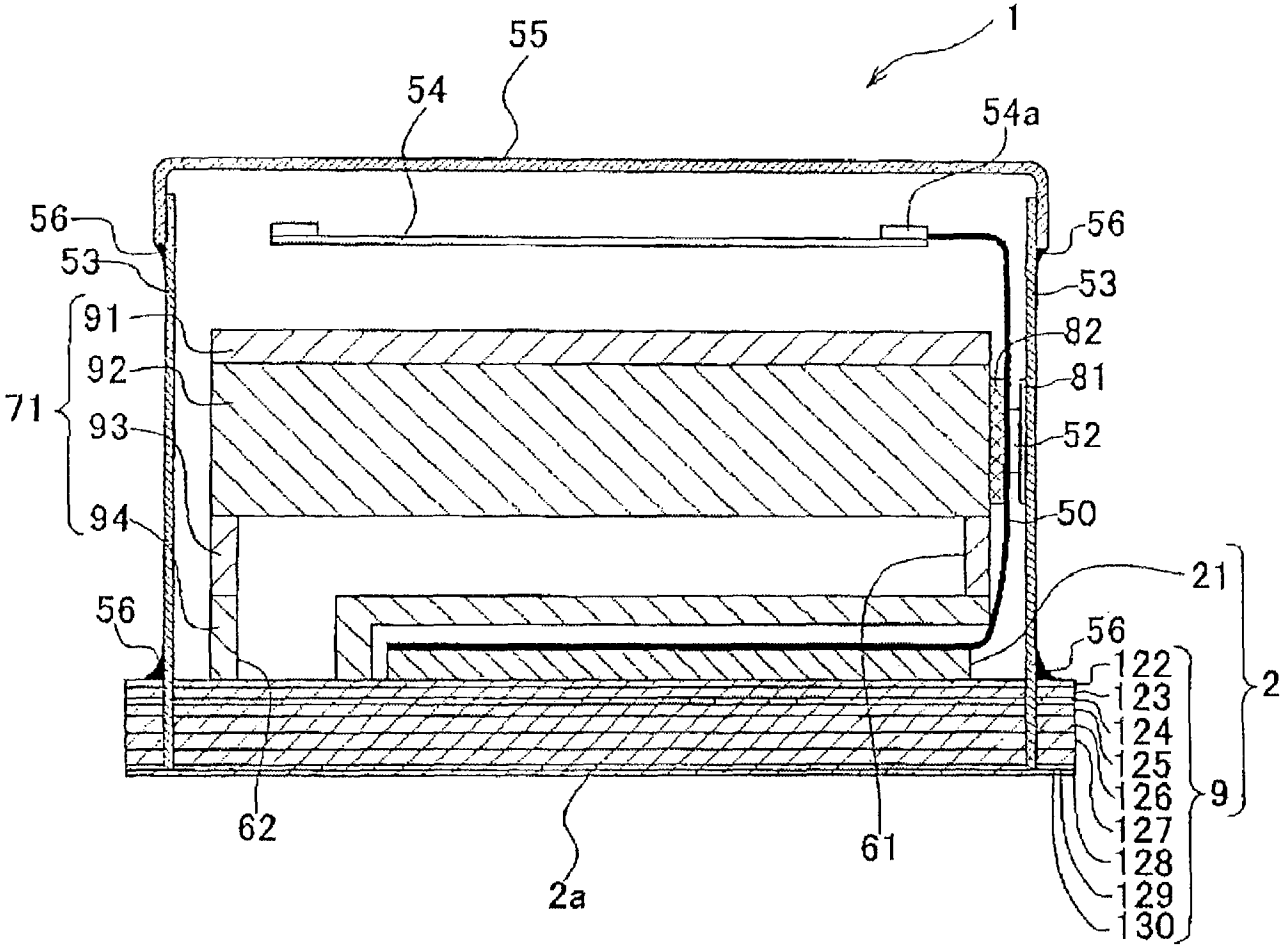
FIG. 3 is a cross-sectional view of a print head of the inkjet recording apparatus of FIG. 1, taken along a width direction of the print head, according to an embodiment of the present invention.

In an embodiment of the present invention, inkjet printer 101 may be a line printer, and may comprise four print heads 1. As shown in FIG. 2, four print heads 1 may be fixedly disposed along the sheet feeding direction, and may correspond to four ink colors: magenta (M), yellow (Y), cyan (C), and black (K). As shown in FIG. 3, each print head 1 may have a head body 2 at its lower end. Head body 2 may have a rectangular parallelepiped shape with a length which may be perpendicular to the sheet feeding direction. Head body 2 may comprise an ink ejection surface 2*a* disposed at a lower end of head body 2, facing outer surface 8*a* of conveyor belt 8.

In an embodiment of the present invention, print head 1, such as the print head corresponding to yellow (Y), may be a monitored print head 1A. As shown in FIG. 4, a driver IC detector 65 of controller 16 may detect or monitor the temperatures of print head 1A. Monitored print head 1A may be selected from print heads 1 that satisfy at least one predetermined condition. For example, a first predetermined condition may be that a first print head 1 is disposed on a side of monitored print head 1A in the sheet feeding direction, and a second print head 1 is disposed on a side of monitored print head 1A in a direction opposite the sheet feeding direction. For example, in the embodiment shown in FIG. 2, a monitored print head 1A may correspond to yellow (Y), a first print head 1 may correspond to cyan (C) and may be disposed on a side of monitored print head 1A in the sheet feeding direction, and a second print head 1 may correspond to magenta (M) and may be disposed on a side of monitored print head 1A in a direction opposite the sheet feeding direction. A second predetermined condition may be that monitored print head 1A corresponds to the print head containing an ink color having the most luminance, i.e., the most perceived brightness, or most lightness. In an embodiment of the invention, print head 1 corresponding to yellow (Y) may contain ink having the most luminance.

In an embodiment, because a first print head 1 may be disposed on a side of print head 1 corresponding to cyan (C) in a sheet feeding direction, and a second print head 1 may be disposed on a side of print head 1 corresponding to cyan (C) in a direction opposite a sheet feeding direction, print head 1 corresponding to cyan (C) may satisfy one predetermined condition required for monitored print head 1A. When monitored print head 1A is positioned between two print heads 1, monitored print head 1 may have reduced heat dissipation efficiency due to heat radiation from adjacent print heads 1. This reduced heat dissipation efficiency may increase ambient temperatures in the vicinity of monitored print head 1A. In another embodiment of the present invention, an inkjet printer may comprise six print heads, each corresponding to one of light magenta, light cyan, magenta, cyan, yellow, and black. In this embodiment, print heads corresponding to light magenta and light cyan ink color may be selected as a monitored print head because those print heads satisfy the condition of the ink color having the most luminance. Print heads corresponding to the ink color having the most luminance may eject ink therefrom with a higher frequency than other print heads 1, so that temperatures of monitored print head 1A are likely to be higher than those of other print heads 1.

As shown in FIG. 1, when sheet P, conveyed by conveyor belt 8, passes just below head bodies 2 of print heads 1, color ink droplets may be ejected from ink ejection surface 2*a* of respective print heads 1. These color ink droplets are ejected onto a print area on an upper surface of sheet P, thus forming a color image on the print area of sheet P.

As shown in FIG. 3, each print head 1 may comprise head body 2, a reservoir unit 71, a chip on film (COP) 50, a printed circuit board (PCB) 54, side covers 53, and a head cover 55. Head body 2 may comprise a flow path unit 9 and an actuator unit 21. Reservoir unit 71 may be disposed on head body 2, and may supply ink to head body 2. COP 50 may be mounted on a driver IC 52, and configured to generate drive signals for driving actuator unit 21. COP 50 and PCB 54 may be electrically connected. Side covers 53 and head cover 55 may prevent ink or ink mist from entering print head 2 from the outside.

As shown in FIG. 3, each head body 2 may comprise flow path unit 9 and actuator unit 21 fixed on the upper surface of flow path unit 9. Flow path unit 9 may comprise laminated metal plates 122-130. Ink ejection surface 2*a* may be provided on a lower surface of flow path unit 9, and ink ejection surface 2*a* may have nozzles through which ink droplets may be ejected. An interior of flow path unit 9 may have a common flow path to which ink may be supplied, and a plurality of individual flow paths, each leading from the common flow path to a corresponding nozzle through a corresponding pressure chamber.

Actuator unit 21 may comprise a plurality of actuators, each actuator corresponding to a respective pressure chamber of flow path unit 9. Actuator unit 21 may be configured to selectively apply ejection energy to ink in the pressure chambers, to eject ink from nozzles. Actuator unit 21 may be a piezoelectric actuator comprising piezoelectric sheets comprising a lead zirconate titanate (PZT)-base ceramic material having ferroelectricity. A piezoelectric sheet may be positioned between a common electrode and a plurality of individual electrodes, each individual electrode corresponding to a respective pressure chamber. The common electrode may be maintained at a ground potential equally throughout its region, relative to any pressure chambers. The individual electrodes may be electrically connected to terminals of driver IC 52 via an internal wiring, e.g., signal lines, of COP 50. Drive signals from driver IC 52 may be selectively input to the individual electrodes. Actuators of actuator unit 21 positioned between the individual electrodes and the pressure chambers may function as individual actuators for the respective pressure chambers. Actuators of actuator unit 21 corresponding to the individual electrodes may concavely deform toward the pressure chambers in response to drive signal inputs to the individual electrodes. Ejection energy, e.g., pressure, may be applied to ink in the pressure chambers, generating pressure waves in the pressure chambers. The pressure waves may propagate from the pressure chambers to the nozzles, causing the nozzles to eject ink droplets therefrom.

Reservoir unit 71 may comprise a plurality of laminated metal plates, e.g., four laminated metal plates 91-94, that may be positioned in proximity to each other, e.g., stacked one on top of another. An interior of reservoir unit 71 may have an ink reservoir 61 and a flow path comprising an ink outflow path 62. Flow path unit 9 may be adhered to a lower surface of reservoir unit 71. Reservoir unit 71 may be in fluid communication with a common flow path of flow path unit 9. Reservoir unit 71 and flow path unit 9 may be thermally connected to each other, so that heat may be transferred from flow path unit 9 to reservoir unit 71. Ink reservoir 61 may be configured to temporarily store ink supplied from an ink tank (not shown). Ink stored in ink reservoir 61 may be supplied to the common flow path of flow path unit 9 via ink outflow path 62.

One end of COF 50 may be adhered to an upper surface of actuator unit 21. An internal wiring of COF 50 may be electrically connected to a plurality of electrodes formed on the upper face of actuator unit 21. COP 50 may be disposed so as to extend upward from the upper face of actuator unit 21, between side cover 53 and reservoir unit 71. An other end of COF 50 may be connected to PCB 54, via a connector 54*a*, so that PCB 54 may relay signals from controller 16 to COP 50.

Driver IC 52 may output drive signals to actuator unit 21 via the wiring of COF 50. As shown in FIG. 4, driver IC 52 may comprise a temperature sensor 52*a*, configured to detect temperatures of driver IC 52. Driver IC 52 may be urged toward side cover 53 by a sponge 82 attached to a side of reservoir unit 71. Driver IC 52 may be thermally connected to side cover 53 via a radiation sheet 81 which may contact an inner surface of side cover 53.

Driver IC 52 may comprise a plurality of semiconductors, a portion of which may be used as temperature sensor 52*a*. An energy gap of the plurality of semiconductors may vary with temperature changes. Specifically, as temperatures increase, the energy gap of the plurality of semiconductors may decrease. This temperature characteristic of the plurality of semiconductors exhibits linearity across a wide range of temperatures. Driver IC 52 may output a voltage corresponding to the energy gap from an output terminal, which may be used to identify a temperature of driver IC 52.

Each side cover 53 may be formed of a metal plate that extends upward from a portion near an end of the upper surface of flow path unit 9, in a width direction of flow path unit 9. A lower end of each side cover 53 may engage in a groove of flow path unit 9, allowing side covers 53 and flow path unit 9 to thermally bond with each other. As described above, driver IC 52 and side covers 53 may be thermally bonded with each other, and Reservoir unit 71 and flow path unit 9 also may be thermally bonded with each other. Thus, driver IC 52, side covers 53, flow path unit 9 and reservoir unit 71 all may be thermally bonded, allowing heat from driver IC 52 to dissipate into the atmosphere, through one or more of side covers 53, flow path unit 9, and reservoir unit 71.

Head cover 55 may be disposed on side covers 53, to seal a portion above flow path unit 9. Reservoir unit 71, COF 50, and PCB 54 may be disposed in an area enclosed by side covers 53 and head cover 55. A sealing member 56 may comprise a resin material e.g., silicone, which may be applied to a joint between each side cover 53 and flow path unit 9, and also applied to an attachment portion between each side cover 53 and head cover 55. Once applied, sealing members 56 may reduce entry of ink or ink mist from the outside.

Referring to FIG. 4, a controller 16 according to an embodiment of the invention will be described in detail below. As shown in FIG. 4, controller 16 may comprise a print data storage section 63, a driver IC temperature detector 65, an ambient temperature detector 80, a print cycle determination section 70, a driver IC driving section 64, a stopping section 66, a resuming section 67, a feeding motor controller 68, and a sheet locating controller 69.

Print data storage section 63 may store print data transferred from a data source, e.g., a host computer (not shown). Print data may be any data used during printing, e.g., the number of sheets P to be printed consecutively, and image data to be printed on sheets P. Driver IC temperature detector 65 may detect or determine a temperature T of driver IC 52 of monitored print head 1A, from output results of temperature sensor 52*a* of each driver IC 52.

Ambient temperature detector 80 may detect an ambient temperature of monitored print head 1A. A signal output from an outside temperature sensor 80*a* may be input to ambient temperature detector 80. In an embodiment of the invention, outside temperature sensor 80*a* may be disposed in a space between monitored print head 1 and an adjacent print head 1.

Print cycle determination section 70 may comprise a print cycle regulating section 70, and may determine a print cycle for forming an image on sheet P. A print cycle may refer to a cycle of ink ejection from nozzles, e.g., the time required for belt conveyor mechanism 13 to convey sheet P a unit distance, in association with a resolution of an image to be printed on sheet P. As the print cycle becomes shorter, the time needed for printing also may become shorter.

More specifically, when driver IC temperature detector 65 detects that a temperature T is lower than a predetermined regulating temperature Tre, e.g., 120 degrees Celsius, print cycle determination section 70 may fix the print cycle to a first predetermined print cycle. When driver IC temperature detector 65 detects that a temperature T is equal to or greater than regulating temperature Tre, print cycle determination section 70 may fix the print cycle to a second predetermined print cycle, which may be longer than the first print cycle. Print cycle determination section 70 may calculate the second print cycle by determining a cycle in which driver IC temperature detector 65 may complete printing on all sheets P without detecting temperature T equal to or greater than an upper limit temperature Toff, e.g., 150 degrees Celsius, and also without detecting temperature T equal to or lower than regulating temperature Tre during printing on all sheets P, based on a plurality of factors, e.g., the ambient temperature detected by ambient temperature detector 80, the number of sheets P to be printed consecutively, the print duty ratio with respect to each image data to be printed on one sheet P, and temperature T detected by driver IC temperature detector 65. Once print cycle determination section 70 calculates the second print cycle, printing may be performed using the second print cycle from the following sheet P.

Print cycle regulating section 70*a* may regulate an interval of the second print cycle, which may be calculated by print cycle determination section 70, to remain at or below a predetermined upper limit interval. In a case when the interval of the second print cycle obtained by calculation exceeds the upper limit interval, the interval of the second print cycle may be limited to the upper limit interval. When print cycle regulating section 70*a* adjusts the interval of the regulated print cycle to the upper limit interval, driver IC temperature detector 65 may detect temperature T greater than or equal to predetermined upper limit temperature Toff, before completing the printing on all sheets P. If driver IC temperature detector 65 detects temperature T greater than or equal to predetermined upper limit temperature Toff, stopping section 66 may stop driver IC 52, described further herein.

Driver IC driving section 64 may drive driver IC 52 of each print head 1, to form an image on sheets P, based on the print cycle determined by print cycle determination section 70.

To prevent thermal destruction of driver IC 52, stopping section 66 may be configured to stop driver IC 52. Specifically, when driver IC temperature detector 65 detects temperature T equal to or greater than predetermined upper limit temperature Toff, stopping section 66 may prevent driver IC driving section 64 from driving driver IC 52, after printing of current page P is completed. In order to prevent thermal destruction of driver IC 52, upper limit temperature Toff may be set to a temperature lower than a temperature at which thermal destruction of driver IC 52 may occur. Driver IC temperature detector 65 may detect temperature T greater than or equal to upper limit temperature Toff at any time during printing, e.g., when print cycle regulating section 70*a* adjusts the interval of the second print cycle to an upper limit interval, or when ambient temperatures are suddenly increased during printing.

If printing is stopped by stopping section 66, then resuming section 67 may resume printing at a later time. Specifically, after stopping section 66 stops driver IC 52, when driver IC temperature detector 65 detects that temperature T of driver IC 52 becomes less than or equal to a resuming temperature Ton, e.g., 100 degrees Celsius, resuming section 67 may allow driver IC driving section 64 to resume driving driver IC 52.

Feeding motor controller 68 may control feeding motor 19, and may cause feeding motor 19 to drive conveyor belt 8 to feed sheet P at a speed corresponding to the print cycle determined by print cycle determination section 70. When print cycle determination section 70 determines a first print cycle, conveyor belt 8 may be driven to feed sheet P at a first speed. When print cycle determination section 70 determines a second print cycle, conveyor belt 8 may be driven to feed sheet P at a second speed lower than the first speed.

Sheet locating controller 69 may control sheet locating motor 11*d*, which may control a rotation of pick-up roller 11*c*. Sheet locating controller 69 may determine whether sheet P, fed by pick-up roller 11*c*, reaches print standby position A, based on a detection result received from sheet detection sensor 59. When sheet P reaches print standby position A, rotation of pick-up roller 11*c* may be temporarily stopped. When the rotation of pick-up roller 11*c* is stopped, if stopping section 66 stops driver IC 52, sheet P may be left at print standby position A. Sheet P may stay at print standby position A until resuming section 67 allows driver IC driving section 64 to drive driver IC 52 again.

Figure 5:
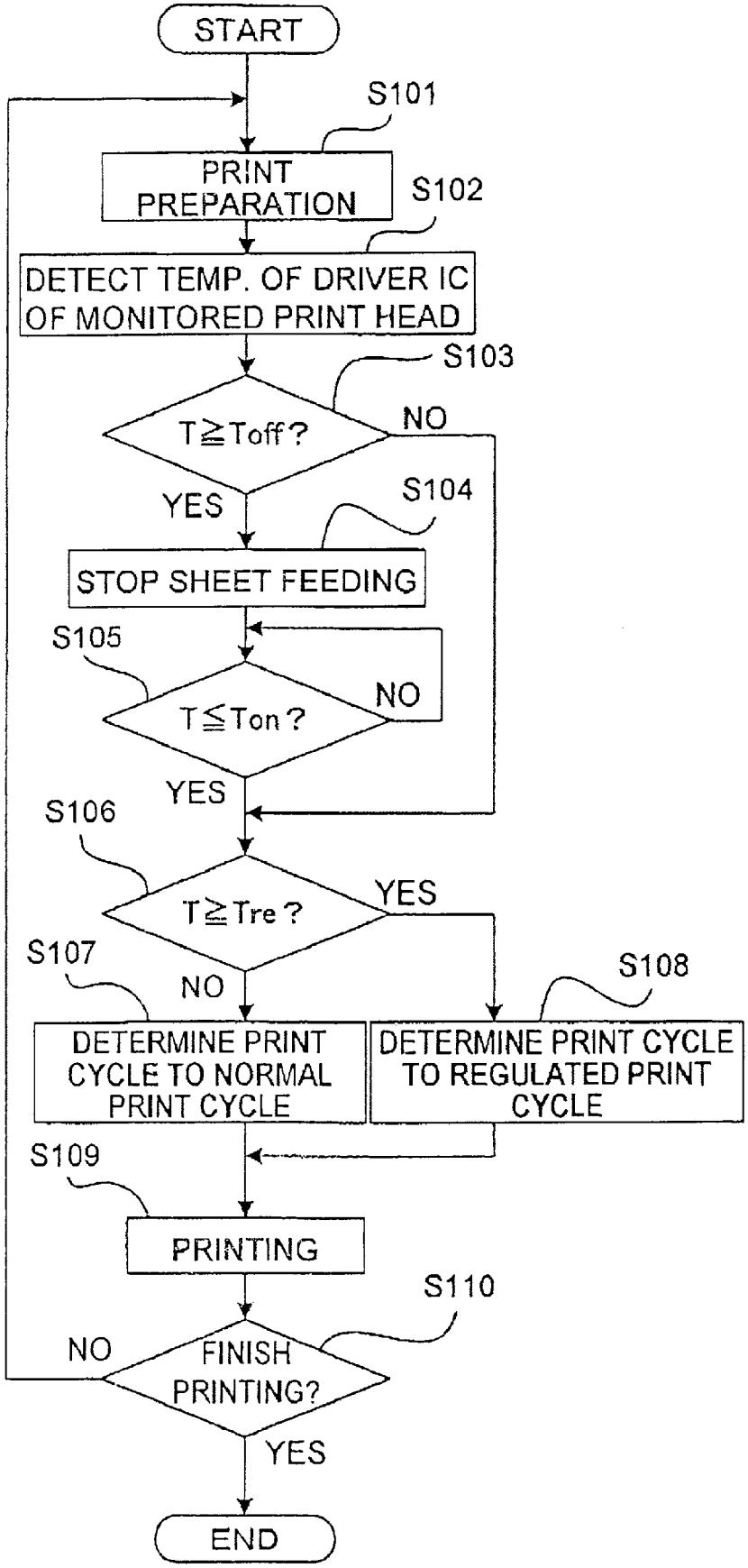
FIG. 5 is a flowchart showing an operation of the controller of FIG. 4, according to an embodiment of the present invention.

Referring to FIG. 5, operations of controller 16, according to an embodiment of the invention, will be described in detail below. As shown in FIG. 5, as a printing operation is started, step S101, print preparation may be performed by driving pick-up roller 11*c*, with sheet locating controller 69 to feed sheet P to print standby position A. Subsequently, in step S102, driver IC temperature detector 65 may detect temperature T of driver IC 52 of monitored print head 1A.

In step S103, if temperature T is not greater than or equal to upper limit temperature Toff (S103: NO), then step S106, described herein, is executed. If temperature T detected by driver IC temperature detector 65 is greater than or equal to the upper limit temperature Toff (S103: YES), then, in step S104, stopping section 66 may stop driver IC driving section 64 from driving driver IC 52, and feeding motor controller 68 may stop conveyor belt 8. Then, in step S105, if temperature T detected by driver IC temperature detector 65 is not reduced to resuming temperature Ton (S105: NO), driver IC 52 and conveyor belt 8 may wait until driver IC temperature detector 65 detects that temperature T is less than or equal to resuming temperature Ton. When driver IC temperature detector 65 detects temperature T less than or equal to resuming temperature Ton, e.g., driver IC 52 has naturally cooled off, (S105: YES), step S106 may be executed.

In step 106, if driver IC temperature detector 65 detects temperature T not greater than or equal to regulating temperature Tre (S106: NO), then, in step 107, print cycle determination section 70 may determine the print cycle as a first print cycle. If driver IC temperature detector 65 detects temperature T greater than or equal to regulating temperature Tre (S106: YES), then, in step S108, print cycle determination section 70 may calculate the second print cycle. The print cycle determination section 70 may calculate the second print cycle from a plurality of factors, e.g. an ambient temperature detected by ambient temperature detector 80, the number of sheets P to be printed consecutively, print duty ratio with respect to each image data to be printed on one sheet P, and temperature T detected by driver IC temperature detector 65. Print cycle determination section 70 may determine the print cycle to the calculated second print cycle.

Subsequently, in step S109, printing may be performed on a following sheet P, based on the print cycle determined by print cycle determination section 70. At this time, if driver IC 52 has been stopped by stopping section 66, resuming section 67 may allow driver IC driving section 64 to resume driving driver IC 52, and may allow sheet locating controller 69 to resume a rotation of pick-up roller 11*c*. For printing, sheet locating controller 69 may drive pick-up roller 11*c* at a predetermined timing to place sheet P, located at print standby position A, over outer surface 8*a* of conveyor belt 8. When printing is completed for one sheet P, then, in step S110, controller 16 determines whether printing on all sheets P is complete. If printing is not complete for all sheets P (S110: NO), the above-described steps are repeated for printing on the following sheet P, starting with step S101. If printing is complete for all sheets P (S110: YES), the operation of controller 16 is completed.

Figure 6:
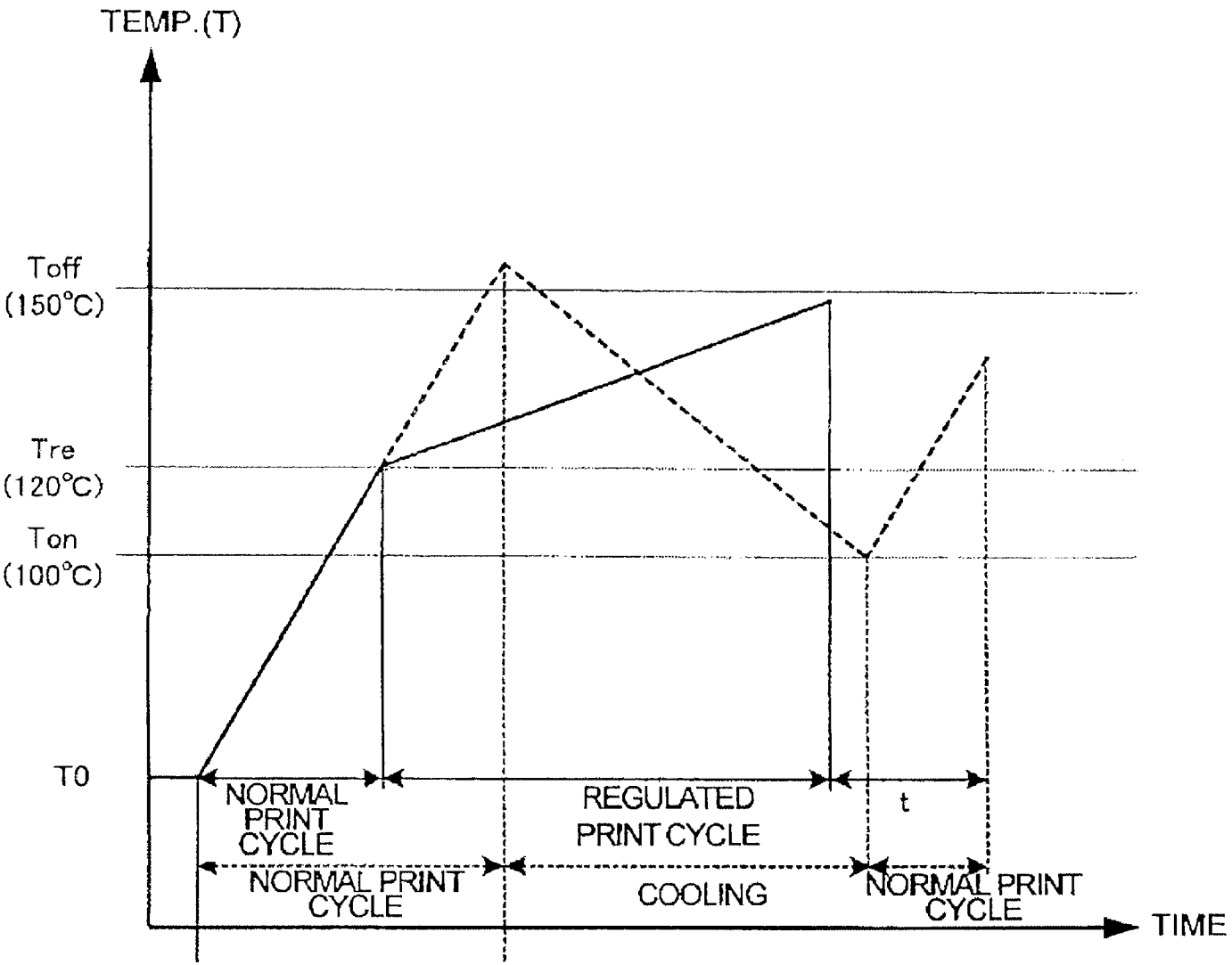
FIG. 6 is a graph showing changes in temperatures over time of a driver IC of the print head of FIG. 3, according to an embodiment of the present invention.

Referring to FIG. 6, changes in temperatures of driver IC 52 of monitored print head 1A, over a period of time, will be described below. The solid line in FIG. 6 shows an example of temperature changes of driver IC 52 of monitored print head 1A, when printing is performed consecutively on a plurality of sheets P. The dashed line in FIG. 6 represents an example of temperature changes of driver IC of a known inkjet printer, when printing is performed at a fixed normal print cycle under substantially the same printing conditions as the printing by inkjet printer 101. The vertical and horizontal axes of the graph represent temperature T and time, respectively. TO represents an initial temperature of driver IC 52 placed in a standby state.

As shown in FIG. 6, temperature T of driver IC 52 increases as printing is performed in a first print cycle on a plurality of sheets P. When temperature T of driver IC 52 becomes greater than or equal to regulating temperature Tre, print cycle determination section 70 may calculate a second print cycle that will not cause driver IC temperature detector 65 to detect temperature T greater than or equal to an upper limit temperature Toff, when printing on all sheets P is complete, and that also will not cause driver IC temperature detector 65 to detect temperature T less than or equal to regulating temperature Tre during printing. Print cycle determination section 70 may calculate the second print cycle, based on a plurality of factors, e.g., the ambient temperature detected by ambient temperature detector 80, the number of sheets P to be printed consecutively, print duty ratio with respect to each image data to be printed on one sheet P, and temperature T detected by driver IC temperature detector 65. The print cycle is then set to the calculated second print cycle. For example, when the ambient temperature is low and a difference between the ambient temperature and temperature T of driver IC 52 is large, or the number of remaining sheets P to be printed is small, or print duty ratio with respect to image data to be printed on the remaining sheets P is low, a shorter regulated print cycle may be set. Printing may be performed at the regulated print cycle for the following sheets P.

As described above, the second print cycle may be longer than the first print cycle, so that the speed of printing performed at the second print cycle may be lower than that at the first print cycle. When the speed of printing decreases, driving frequency of driver IC 52 also may decrease, which may reduce an amount of heat radiated by driver IC 52. If an amount of heat radiated by driver IC 52 is reduced, a ratio of heat dissipated by natural cooling to heat radiated by driver IC 52 becomes relatively higher, which may slow down a rise in temperatures of driver IC 52 per unit print area. Thus, by changing the print cycle to the second print cycle, the number of sheets P to be consecutively printed, or a consecutively printable area, may increase.

When printing may be performed consecutively on a plurality of sheets P only at the first print cycle, temperature T of driver IC 52 may exceed upper limit temperature Toff, which may cause stopping section 66 to stop driver IC 52 from driving. Driver IC 52 may then cool naturally. When Temperature T of driver IC 52 becomes less than or equal to resuming temperature Ton, resuming section 67 may resume driving driver IC 52, allowing printing to finish on all sheets P. If the print cycle is fixed to a first print cycle, as in a known inkjet printer, and illustrated in FIG. 6 by the dotted line, a frequency of stopping the known driver IC to cool the known driver IC off may increase. Consequently, the time required for printing at a first print cycle by a known printer may become longer in total. This additional time required for the known printer is indicated by the period of time "t" as indicated in FIG. 6.

As described above, monitored print head 1A may be positioned between other print heads 1. Further, monitored print head 1A may eject droplets of ink having the most luminance, e.g., yellow ink in an embodiment. The frequency of ejecting ink from monitored print head 1A generally may be higher than the frequency of ejecting ink from other print heads 1. Thus, the temperature of driver IC 52 of monitored print head 1A may be likely to increase its more quickly, compared with the temperatures of driver ICs 52 of other print heads 1. Controller 16 may monitor temperatures of driver IC 52 of monitored print head 1A. When temperature T of driver IC 52 of monitored print head 1 becomes or greater than or equal to a regulating temperature Tre, the print cycle is changed to the second print cycle, which may be longer than the first print cycle, in order to slow a rise in temperatures of driver IC 52. Thus, thermal destruction of driver IC 52 may be prevented and the useful life of driver IC 52 may increase. When the second print cycle is employed, a ratio of heat dissipated by natural cooling to radiated heat may become relatively higher, and a rise in temperatures of driver IC 52 per unit print area is lower than when printing is performed in the first print cycle. Thus, the number of times that driver IC 52 is stopped for cooling may be reduced, and printing speed may be increased.

When driver IC temperature detector 65 detects temperature T greater than or equal to regulating temperature Tre, print cycle determination section 70 may calculate the second print cycle, which may be longer than the first print cycle. Print cycle determination section 70 may calculate the second print cycle so that driver IC temperature detector 65 may not detect temperature T greater than or equal to upper limit temperature Toff, when printing on all sheets P is complete, and also so that driver IC temperature detector 65 will not detect temperature T lower than or equal to regulating temperature Tre during printing, based a plurality of factors, e.g., on the ambient temperature detected by ambient temperature detector 80, the number of sheets P to be printed consecutively, print duty ratio with respect to each image data to be printed on one sheet P, and temperature T detected by driver IC temperature detector 65. During a second print cycle, the number of sheets P that may be consecutively printed, may increase, which in turn, may lead to increased printing speed. The second print cycle may be calculated based on one or more factors, e.g., on the ambient temperature detected by ambient temperature detector 80, so that an efficient second print cycle may be determined in accordance with the changes of the ambient temperatures surrounding monitored print head 1A, which may effectively increase printing speed.

Figure 7:
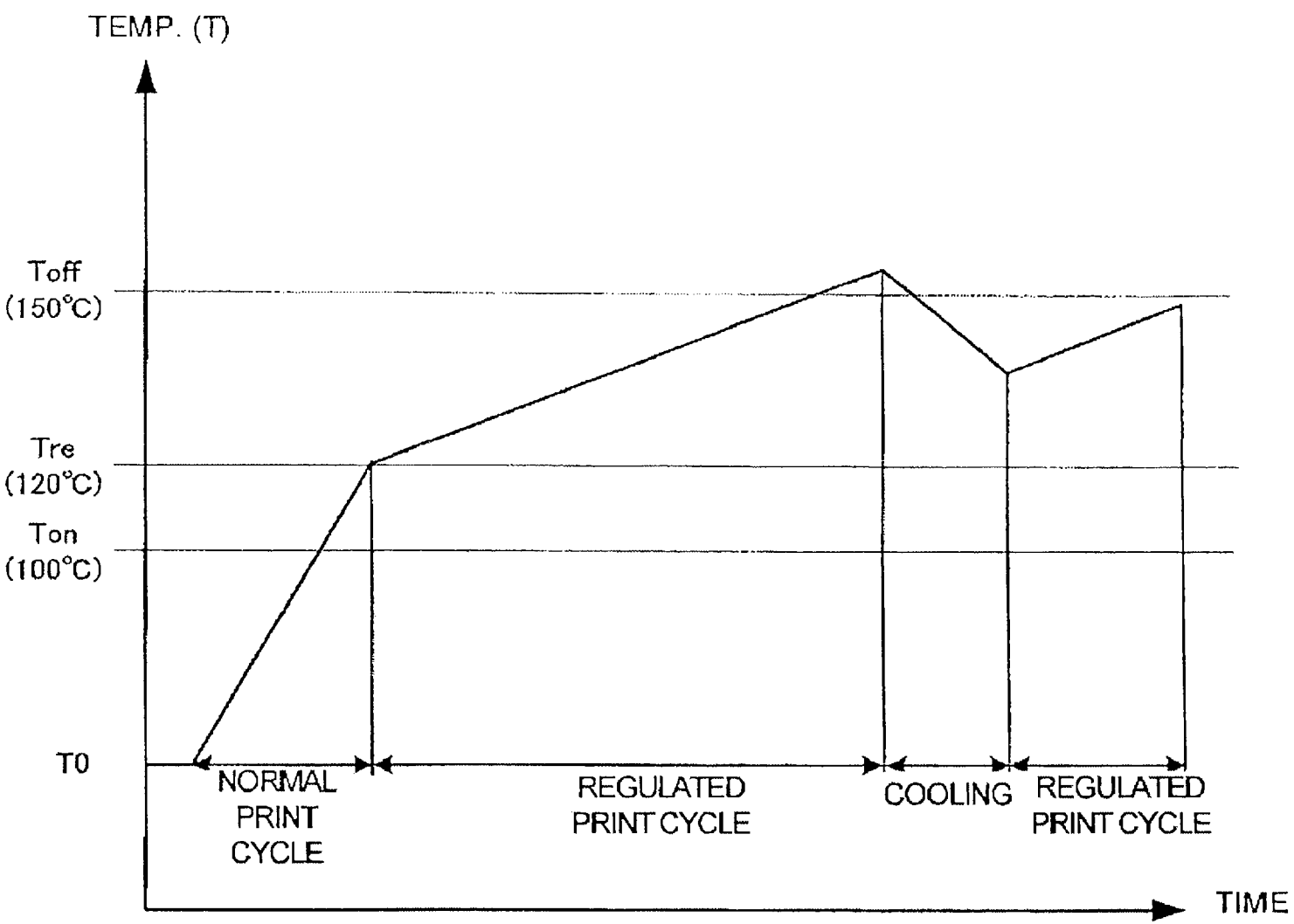
FIG. 7 is a graph showing changes in temperatures over time of a driver IC of a print head according to another embodiment of the present invention.

In an embodiment of the invention, resuming section 67 may allow driver IC driving section 64 to resume driving driver IC 52 after stopping section 66 stops driver IC 52, when temperature T of driver IC 52 detected by driver IC temperature detector 65 becomes equal to or less than resuming temperature Ton. In another embodiment of the invention, as shown in FIG. 7, after driver IC temperature detector 65 detects a temperature T of driver IC greater than or equal to upper limit Toff, and after stopping section 66 stops driver IC driving section 64 from driving driver IC 52, driver IC 52 may be driven again at any time. For example, after stopping section 66 stops driver IC 52, driver IC 52 may be driven again at a time when temperature T of driver IC 52 is greater than or equal to regulated temperature Tre, but does not exceed upper limit temperature Toff. Controller 16 may estimate the temperature T of driver IC 52 at a time when printing on all sheets P is complete, and resuming section 67 may allow driver IC driving section 64 to resume driving driver IC 52 if controller 16 estimates that printing on all sheets P will be completed before a temperature T of driver IC 52 becomes greater than or equal to upper limit temperature Toff again. In this case, driving section 64 may quickly resume driving driver IC 52. Thus, the period of time that driver IC 52 is stopped may be reduced.

In an embodiment, print cycle determination section 70 may calculate the second print cycle, based on a plurality factors, e.g., the ambient temperature detected by ambient temperature detector 80, the number sheets P to be consecutively printed, duty ratio with respect to each image data to be printed on one sheet P, and temperature T detected by driver IC temperature detector 65. In another embodiment, the second print cycle may be determined based on any other suitable manners or methods for calculation. In still another embodiment, a second print cycle may be determined by referencing a table that associates parameters, e.g., the ambient temperatures to be detected by ambient temperature detector 80, the number of sheets P to be consecutively printed, duty ratio with respect to each image data to be printed on one sheet P, and temperatures T to be detected by driver IC temperature detector 65, with a second print cycle. In yet another embodiment, a fixed second print cycle may be used.

In an embodiment of the invention, inkjet printer 101 may comprise four print heads 1, however in other embodiments, the number of print heads 1 may be more or less than four, but not less than 3. In an embodiment of the invention, actuator unit 21 may be a unimorph actuator employing piezoelectric sheets, however any other types of actuators that apply energy to pressure chambers for ink ejection from print heads may be used.

In another embodiment of the invention, print cycle determination section 70 may maintain the first print cycle, even if driver IC temperature detector 65 detects temperature T equal to or greater than regulating temperature Tre, if certain factors are met, e.g., the number of remaining sheets P to be printed is small and For example, if the number of remaining sheets P to be printed is one or two, printing may be performed in the first print cycle, without changing the print cycle to the regulated print cycle.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

a nozzle from which an ink droplet is ejected onto the recording medium conveyed by the conveyor to form an image on the recording medium

What is claimed is:

1. An inkjet recording apparatus comprising:

a conveyor configured to convey a recording medium in a conveying direction;

at least one recording head comprising:

a flow path unit;

a driver IC configured to output a drive signal an actuator configured to actuate ink in the flow path based on the drive signal;

wherein at least one recording head of the at least one recording heads further comprises a temperature sensor configured to detect a current temperature of the driver IC of the at least one recording head, and a controller configured to control each of the conveyor and the at least one recording head, wherein the controller comprises:

a detecting unit configured to compare the current temperature with a particular predetermined temperature;

a driving control unit configured to drive the driver IC based at least on the current temperature; and a cycle determining unit configured to determine an ejection cycle of the at least one recording head, wherein when the current temperature is less than the particular predetermined temperature, the driver IC of the at least one recording head is driven in a first ejection cycle, and wherein when the current temperature is greater than or equal to the particular predetermined temperature, the driver IC of the at least one recording head is driven in a second ejection cycle.

2. The inkjet recording apparatus of claim 1, wherein the at least one recording head extends in a direction perpendicular to the conveying direction.

3. The inkjet recording apparatus of claim 1, wherein the second ejection cycle is longer than the first ejection cycle.

4. The inkjet recording apparatus of claim 1, wherein the controller further comprises a conveyor control unit configured to select a speed of the conveyor based on the current temperature.

5. The inkjet recording apparatus of claim 4, wherein when the current temperature is less than the particular predetermined temperature, the speed of the conveyor is a first speed, and wherein when the current temperature is greater than or equal to the predetermined temperature, the speed of the conveyor is a second speed.

6. The inkjet recording apparatus of claim 5, wherein the second speed is less than a first speed.

7. The inkjet recording apparatus of claim 1, wherein when the current temperature is greater than or equal to the predetermined temperature, and greater than or equal to a further predetermined temperature, the driver IC of the at least one recording head is not driven for a predetermined time.

8. The inkjet recording apparatus of claim 1, wherein the at least one recording head comprises:

a first recording head;

a second recording head; and a third recording head positioned between the first recording head and the second recording head, wherein the first recording head is positioned to a first side of the third recording head in the conveying direction, and the second recording head is positioned to a second side of the third recording head in a direction opposite the conveying direction, and wherein the at least one recording head of the at least one recording heads comprises the third recording head.

9. The inkjet recording apparatus of claim 1, wherein the at least one recording head of the at least one recording heads is a recording head corresponding to an ink color having the most value relative to ink colors of other recording heads.

10. The inkjet recording apparatus of claim 9, wherein the controller further comprises an ambient temperature detecting unit configured to detect an ambient temperature around the at least one recording head, and the cycle determining unit is configured to determine the second ejection cycle based on one or more of the ambient temperature, the current temperature, a duty ratio of image data to be recorded on the recording medium, and a number of recording media to be recorded consecutively.

11. The inkjet recording apparatus of claim 10, wherein the cycle determining unit is configured to determine the second ejection cycle based also on one or more of the current temperature, a duty ratio of image data to be recorded on the recording medium, and a number of the plurality of recording media to be recorded consecutively.

12. The recording apparatus of claim 11, wherein the controller further comprises a resuming unit configured to resume driving the driver IC, after the driver IC has been stopped by the stopping unit.

13. The inkjet recording apparatus of claim 1, wherein the cycle determining unit is configured to determine the second ejection cycle to prevent the temperature sensor from detecting a temperature equal to or lower than a predetermined temperature.

14. The inkjet recording apparatus of claim 1, wherein the cycle determining unit is configured to determine the second ejection cycle to prevent the temperature sensor from detecting a temperature equal to or greater than a further predetermined temperature at any time during recording on a plurality of recording media, including the recording medium.

15. The recording apparatus of claim 1, wherein the controller further comprises a stopping unit configured to stop driving the driver IC when the current temperature is greater than or equal to a further predetermined temperature.

16. The recording apparatus of claim 15, wherein the resuming unit is configured to resume driving the driver IC, when the current temperature is equal to or lower than a third predetermined temperature.

17. The recording apparatus of claim 15, wherein the resuming unit is configured to resume driving the driver IC, when the current temperature is greater than or equal to a third predetermined temperature, but will not exceed the further predetermined temperature when recording on a number of recording media, including the recording medium, is complete, based on one or more of the current temperature, a duty ratio of image data to be recorded on the recording medium, and the number of recording media to be recorded consecutively.

* * * * *